US006615458B2

(12) United States Patent
Takasawa et al.

(10) Patent No.: US 6,615,458 B2
(45) Date of Patent: Sep. 9, 2003

(54) RELEASABLE BOTTOM END STOP FOR SLIDE FASTENER

(75) Inventors: Shigeyoshi Takasawa, Toyama-ken (JP); Satoshi Matsumoto, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/984,314

(22) Filed: Oct. 29, 2001

(65) Prior Publication Data

US 2002/0050031 A1 May 2, 2002

(30) Foreign Application Priority Data

Oct. 31, 2000 (JP) ..... 2000-332881

(51) Int. Cl.[7] ..... A44B 19/38

(52) U.S. Cl. ..... 24/433; 24/388; 24/390; 24/434

(58) Field of Search ..... 24/433, 388, 390, 24/334, 434, 432

(56) References Cited

U.S. PATENT DOCUMENTS

| | | | | |
|---|---|---|---|---|
| 5,007,145 A | | 4/1991 | Kim | |
| 5,412,849 A | * | 5/1995 | Fudaki | 24/388 |
| 5,638,585 A | * | 6/1997 | Mizuno | 24/433 |
| 5,950,286 A | * | 9/1999 | Failing et al. | 24/433 |
| 6,009,602 A | | 1/2000 | Terada | |
| 6,088,888 A | * | 7/2000 | Oda | 24/433 |
| 6,112,376 A | * | 9/2000 | Akashi et al. | |
| 6,195,852 B1 | * | 3/2001 | Kusayama | 24/434 |
| 6,481,068 B1 | * | 11/2002 | Takasawa | 24/433 |

FOREIGN PATENT DOCUMENTS

| | | |
|---|---|---|
| CH | 290573 | 5/1953 |
| DE | 2430232 | 1/1976 |
| FR | 1092449 | 4/1955 |
| JP | 63-31607 | 8/1988 |
| JP | 11-178615 | 7/1999 |

* cited by examiner

*Primary Examiner*—Victor Sakran
(74) *Attorney, Agent, or Firm*—Finnegan, Henderson, Farabow, Garrett & Dunner, L.L.P.

(57) ABSTRACT

This invention provides a releasable bottom end stop for slide fastener which allows an insert pin thereof to be operated smoothly on being inserted into a semi-automatic/automatic stop slider. A slope for raising a locking pawl of an automatic or a semi-automatic stop mechanism provided on a slider when the insert pin is inserted into an inverse-opening type slider or an ordinary slider is provided obliquely so as to extend from a front end of the surface of an insert pin to a proximal end thereof. Additionally, a concave portion whose inlet is inclined for holding the locking pawl is provided over this slope. The inverse-opening slider is fitted in a stringer on a box pin side and another slider is also fitted such that it comes into contact with a top of the inverse-opening slider. If the insert pin disposed on another stringer is inserted with this condition, the locking pawl is raised by the slope so that the insert pin can be inserted smoothly and held in a stable condition.

11 Claims, 8 Drawing Sheets

RELEASABLE BOTTOM END STOP FOR SLIDE FASTENER

BACKGROUND OF THE INVENTION

1. Field of the Invention

The present invention relates to a releasable bottom end stop for slide fastener, more specifically, to a releasable bottom end stop, wherein a insert pin of an ordinary type releasable bottom end stop comprised of a box, a box pin and the insert pin or an inverse-opening type releasable bottom end stop comprised of an inverse-opening slider, a box pin and an insert pin is improved, so as to achieve smooth separating and fastening operations.

2. Description of the Related Art

As a conventional releasable bottom end stop, Japanese Utility Model Application Publication No. 63-31607 has disclosed a releasable bottom end stop in which, as shown in FIG. 11, an inner edge of an end portion on a fastener element 18' side of a box pin 3', that is, an edge portion on a fastener tape side is cut out so as to be chamfered in the form of a slope 6'.

Further, in a releasable bottom end stop disclosed in Japanese Patent Application Laid-Open No. 11-178615, as shown in FIG. 12, a corner of a half outer edge portion on a front end side of its insert pin, which a locking pawl 25" of a slider 5" comes into contact with, is cut out in the form of a slope so as to form a slope 6" and then, continuously to that slope 6", an avoiding portion, which avoids engagement of the locking pawl 25", is formed by cutting out other half edge portion up to a proximal portion of a stop portion for the fastener element 18", such that its inner portion forms a slope 6" and its outer portion forms a horizontal face 30".

In the above-described releasable bottom end stop shown in FIG. 11, when the insert pin 4' is inserted into a box 2' to which the box pin 3' is fixed, it comes that the insert pin 4' is inserted in a condition that the slider 5' is inclined and in contact with the box 2'. Because the locking pawl 25' located on the box pin 3' side is moved to a normal position of the box pin 3' together with the slider 5', the edge portion of the box pin 3' is cut out so as to facilitate the moving of the locking pawl 25'. Therefore, this releasable bottom end stop is not applicable when the locking pawl 25' exists on the insert pin 4' side, particularly, for the insert pin 4' of the inverse-opening type releasable bottom end stop.

The releasable bottom end stop shown in FIG. 12 is an ordinary type releasable bottom end stop formed of the box 2", the box pin 3" and the insert pin 4". Thus, this is not applicable for an inverse-opening type releasable bottom end stop employing an inverse-opening slider instead of the box 2". That is, this releasable bottom end stop is incapable of holding the slider disposed at an end of a fastener chain in a stable condition. Further, there is no function of raising the locking pawl 25", so that the slider 5" cannot be started up smoothly even in case that an insert pin 4" of the ordinary type releasable bottom end stop is used.

SUMMARY OF THE INVENTION

Accordingly, the present invention has been achieve in views of the above-described problem and an object of the invention is to provide a releasable bottom end stop for slide fastener having an insert pin suitable for not only an ordinary type releasable bottom end stop comprised of a box, a box pin and the insert pin, but also an inverse-opening type releasable bottom end stop comprised of an inverse-opening slider, a box pin and the insert pin. More specifically, the insert pin may be inserted smoothly into a slider having an automatic stop mechanism or a semi-automatic stop mechanism containing a locking pawl. And the releasable bottom end stop is provided, wherein the slider is maintained stably, the insert pin of the ordinary type or inverse-opening type releasable bottom end stop allows the slider to be started up smoothly and ensuring an excellent function is ensured.

Another object of the invention is to provide a releasable bottom end stop for slide fastener capable of improving the function of the releasable bottom end stop by applying a specific form to the insert pin of an ordinary type releasable bottom end stop comprised of the box, the box pin and the insert pin.

Still another object of the invention is to provide a releasable bottom end stop for slide fastener capable of improving the function of the releasable bottom end stop by applying a specific form to the insert pin of the inverse-opening type releasable bottom end stop comprised of the inverse-opening type slider, the box pin and the insert pin.

Further object of the invention is to provide a releasable bottom end stop for slide fastener capable of expanding a range of the usage of the releasable bottom end stop by forming an insert pin each having a specific form applicable for various types of the slide fasteners.

And further object of the invention is to provide a releasable bottom end stop for slide fastener capable of maintaining the inverse-opening type slider used for the inverse-opening type releasable bottom end stop stably, starting up the inverse-opening type slider smoothly and improving the function of a separation and opening operation of the inverse-opening.

Still further object of the invention is to provide a releasable bottom end stop for slide fastener capable of exerting an excellent function of the separation and fastening operation by providing the box pin of the inverse-opening type releasable bottom end stop with a specific form.

To achieve the above-described objects, according to the invention, there is provided a releasable bottom end stop for slide fastener, wherein an insert pin thereof has a slope for raising a locking pawl of an automatic stop mechanism or a semi-automatic stop mechanism of an inverse-opening slider or a slider when the insert pin is inserted into the inverse-opening slider or the slider, the slope being provided to extend from a front end of the surface of the insert pin to a proximal end thereof. Consequently, the insert pin of the ordinary type or inverse-opening type releasable bottom end stop can be inserted smoothly into the slider or the inverse-opening type slider having the automatic stop mechanism or semi-automatic stop mechanism. Further, the slider can be started up smoothly thereby exerting an excellent function as the releasable bottom end stop.

Preferably, the insert pin of the ordinary type releasable bottom end stop comprised of a box, a box pin and the insert pin has the slope for raising the locking pawl of the slider having the automatic stop mechanism or the semi-automatic stop mechanism provided on a fastener chain. Consequently, the mechanism having such an excellent releasable bottom end stop function can be applied to the insert pin of the ordinary type releasable bottom end stop.

Alternately, the insert pin of an inverse-opening type releasable bottom end stop comprised of an inverse-opening slider, the box pin and the insert pin has the slope for raising the locking pawl of the slider having the automatic stop mechanism or the semi-automatic stop mechanism provided on the fastener chain. Consequently, the mechanism having such an excellent releasable bottom end stop function can be applied to the insert pin of the inverse-opening type releasable bottom end stop. Further, in a conventional inverse opening slider, a special slider, wherein the locking pawl does not protrude into an insertion route through which the insert pin is inserted into the guide groove, is used. On the contrary, in this invention, such a special slider is not needed, that is, a usual slider can be used.

Preferably, the slope for raising the locking pawl of the automatic stop mechanism or the semi-automatic stop mechanism and being formed on the insert pin of the releasable bottom end stop is provided obliquely in the entire width of the surface of the insert pin. Consequently, this releasable bottom end stop can be applied to any slider having an automatic stop mechanism or semi-automatic stop mechanism of the ordinary type and the inverse-opening type releasable bottom end stop.

Alternately, the slope for raising the locking pawl of the automatic stop mechanism or the semi-automatic stop mechanism and being formed on the insert pin of the releasable bottom end stop is provided obliquely on an inner side of the surface of the insert pin. Consequently, a reduction of the mounting strength of the insert pin is prevented.

Also alternately, the slope for raising the locking pawl of the automatic stop mechanism or the semi-automatic stop mechanism and being formed on the insert pin of the releasable bottom end stop is provided obliquely on both front and rear surfaces of the insert pin. Consequently, the insert pin can be inserted into the right side or the left side of the ordinary type and the inverse-opening type releasable bottom end stop, so that it is adaptable for reversible clothes such as a jumper easily.

Preferably, a concave portion for fitting and holding the locking pawl of the inverse-opening slider having the automatic stop mechanism or the semi-automatic stop mechanism therein is provided nearer a proximal end of the insert pin of the inverse-opening type releasable bottom end stop than the slope provided obliquely thereon. Consequently, the inverse-opening type slider can be held with the insert pin of the inverse-opening type releasable bottom end stop in a very stable condition.

Further preferably, the concave portion for fitting and holding the locking pawl of the inverse-opening slider having the automatic stop mechanism or the semi-automatic stop mechanism therein and provided in the insert pin of the inverse-opening type releasable bottom end stop has a chamfered portion formed obliquely on an inlet portion thereof. Consequently, the inverse-opening type slider can be started up very smoothly.

Still further, a protrusion for preventing the inverse-opening slider inserted through the fastener chain from escaping is provided at a front end of the box pin of the inverse-opening releasable bottom end stop. Consequently, with such a simple structure, the inverse-opening type slider can be held with the box pin in a stable condition.

Further, an expanded portion for saving the insert pin is provided on an outer side face on the side of a front end of the box pin of the inverse-opening type releasable bottom end stop in order to avoid a collision of the insert pin with a diamond. Consequently, when the insert pin is inserted into the inverse-opening type slider, it can be inserted smoothly without collision with the diamond of the slider.

And further, the slope for raising the locking pawl of the inverse-opening slider having the automatic stop mechanism or the semi-automatic stop mechanism is provide on an end portion on the side of the fastener element of the box pin of the inverse-opening type bottom end stop. Consequently, the box pin of the inverse-opening type releasable bottom end stop has a locking pawl raising mechanisms so as to achieve a smooth slider opening/closing operation of the slider.

DESCRIPTION OF THE PREFERRED EMBODIMENTS

Hereinafter, the preferred embodiments of the releasable bottom end stop for slide fastener of the invention will be described in detail with reference to the accompanying drawings.

Figure 6:
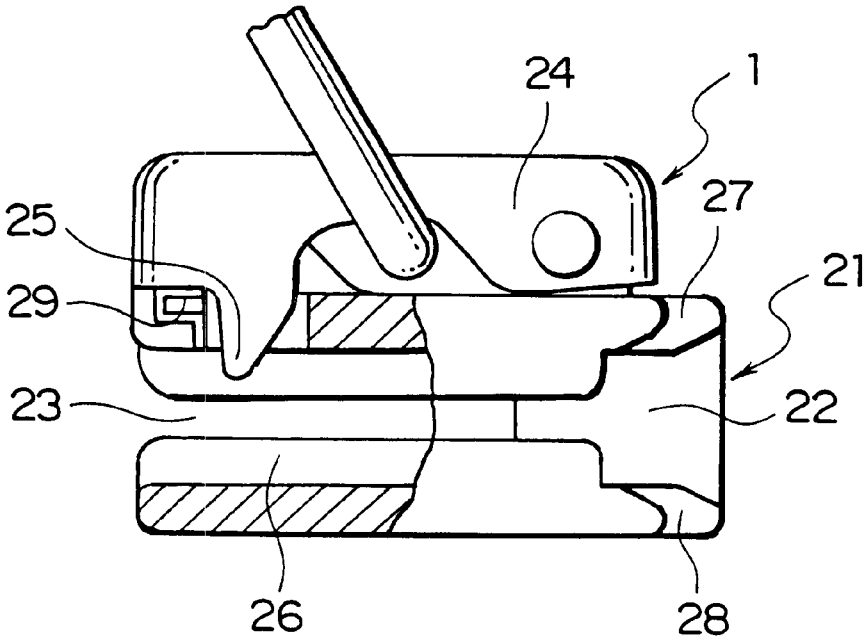
FIG. 6 is a partially cut-out front view of a slider provided with an automatic stop mechanism.

Such as the releasable bottom end stop of a first embodiment of the invention, as shown in FIGS. 1 to 4, this releasable bottom end stop for the slide fastener of the invention is comprised of such three members as an inverse-opening slider 1, a box pin 3 and an insert pin 4. A slider 5 for opening/closing a fastener chain 15 is inserted through the fastener chain 15 as well as the inverse-opening slider 1. In the inverse-opening slider 1 and the slider 5, as shown in FIG. 6, a body 21, in which an upper plate 27 and a lower plate 28 disposed in parallel to each other are connected through their ends with a diamond 22, is molded by die-casting with metal such as zinc alloy and aluminum alloy. A cover 24 having a locking pawl 25 protruded at a side face thereof is formed by pressing a metal plate and then mounted on the body 21. A spring 29 is provided between the mounted cover 24 and the body 21, so that the locking pawl 25 is automatically protruded resiliently into a guide groove 23 for guiding fastener elements 18 of the body 21.

In the fastener chain 15, the fastener elements 18 are formed by injection molding with such thermoplastic resin as polyamide, polyacetal, polypropylene, polybutylene terphthalate with every predetermined interval along an expanded core portion 19 disposed on each of opposing side edges of the fastener tapes 17 of a pair of fastener stringers 16. At an end portion of each of the fastener stringers 16, a box pin 3 and a insert pin 4, each in the form of a square bar, are molded on reinforcement tapes 20 welded so as to wrap the fastener tape 17 and the core portion 19, by injection molding with the aforementioned thermoplastic resin, while each of them adjoins a fastener element 18. In this case, the box pin 3 and the insert pin 4 are formed in the form of a square bar substantially 1.5 times longer than the inverse-opening slider 1 and the slider 5.

Figure 1:
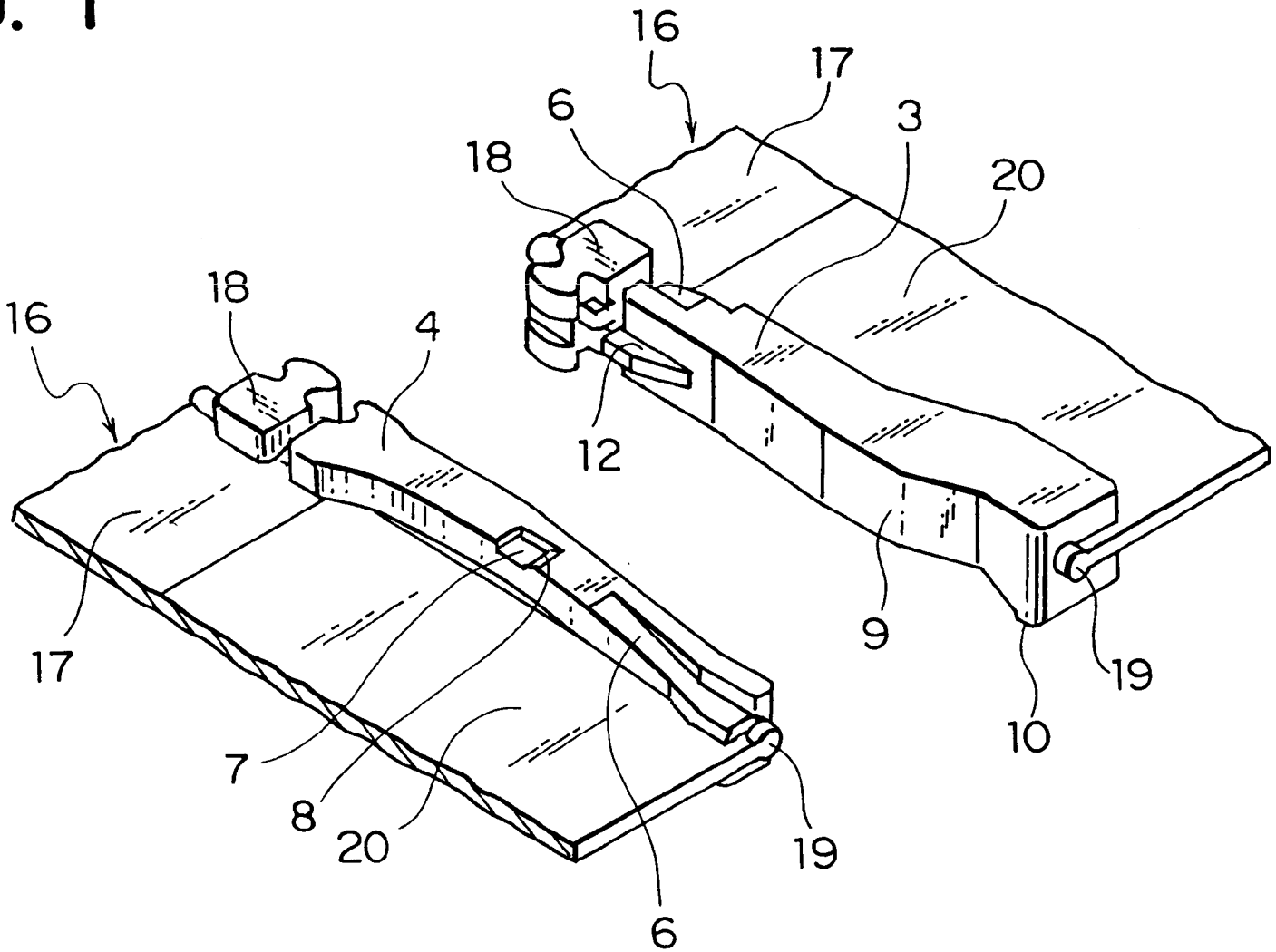
FIG. 1 is a perspective view showing a box pin and an insert pin of an inverse-opening type releasable bottom end stop.
Figure 2:
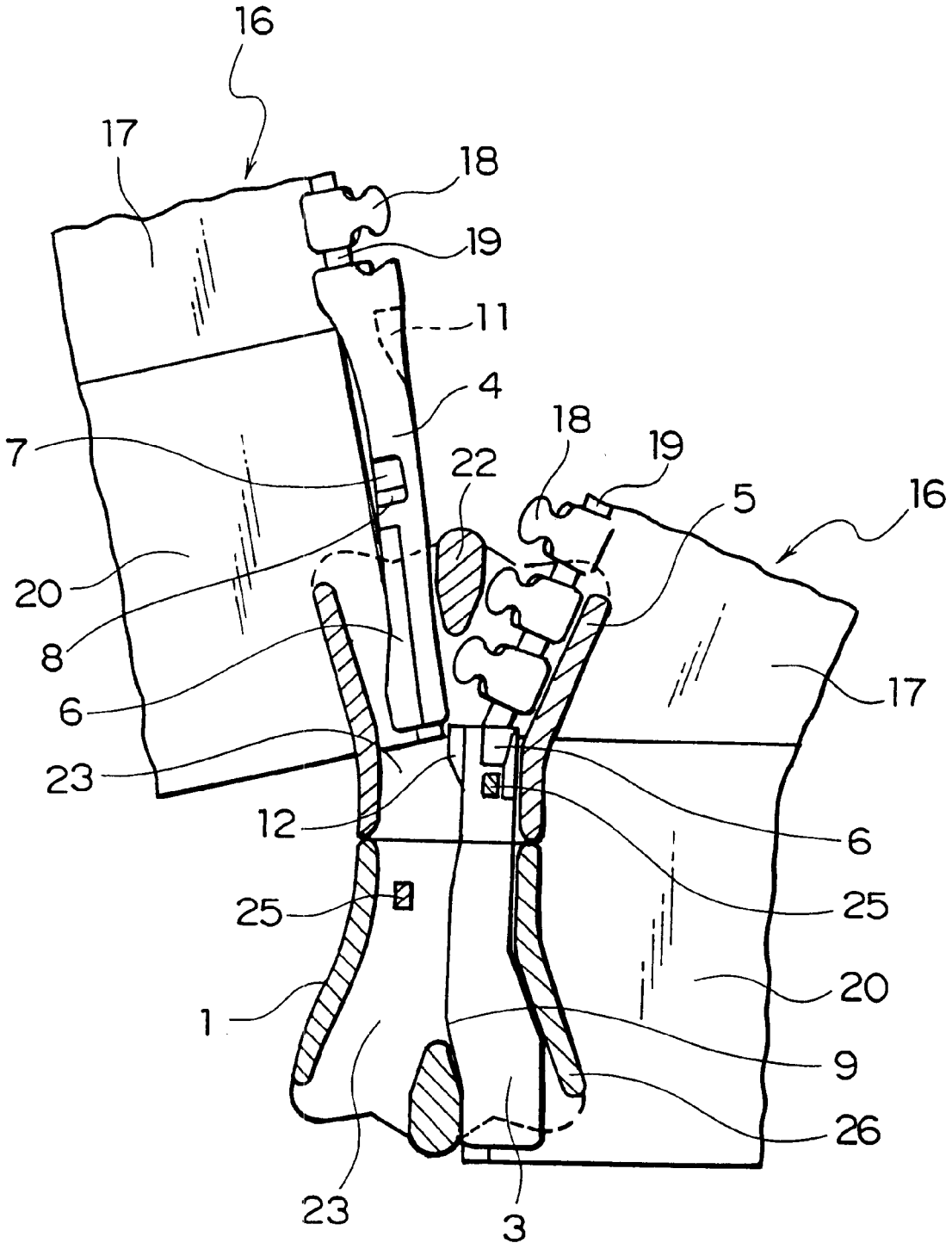
FIG. 2 is a partially sectional view showing an initial phase of an insertion of the insert pin in the releasable bottom end stop of FIG. 1.
Figure 3:
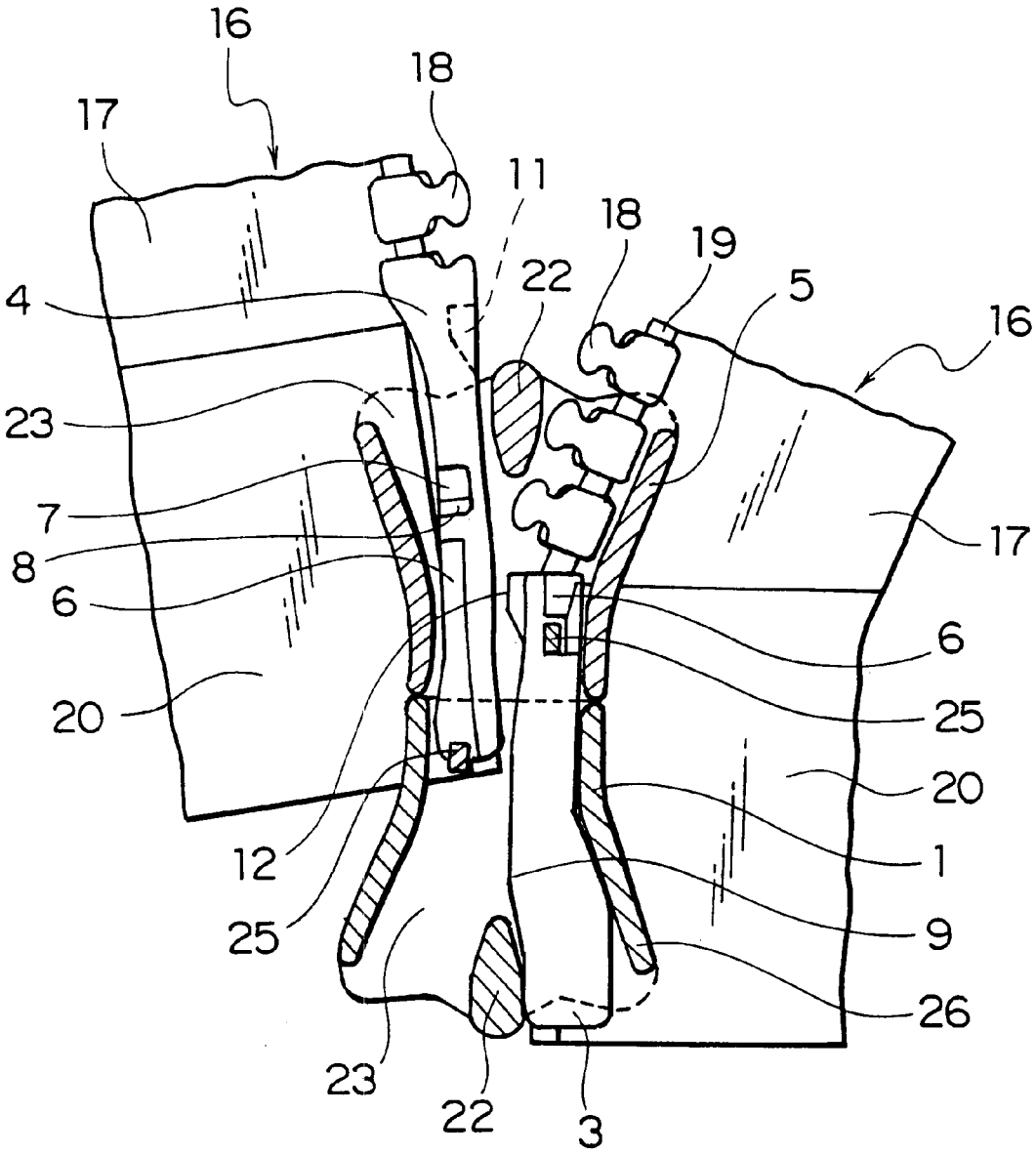
FIG. 3 is a partially sectional view showing an intermediate phase of the insertion of the insert pin in the releasable bottom end stop of FIG. 1.
Figure 4:
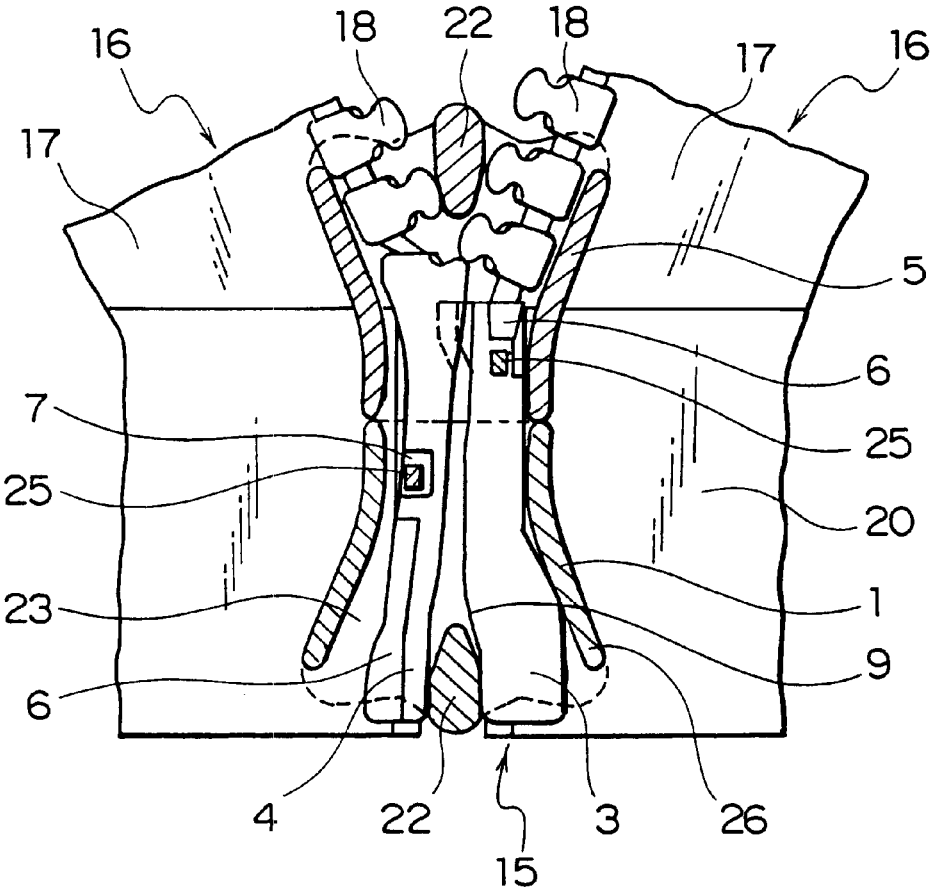
FIG. 4 is a partially sectional view showing a state in which the insert pin of the releasable bottom end stop of FIG. 1 is inserted completely.

As shown in FIG. 2, the box pin 3 has a small protrusion 10 shown in FIG. 1, which is protruded from a rear surface of a front end thereof, so that the inverse-opening slider 1 may not escape when the box pin 3 is inserted into the guide groove 23 for guiding the fastener elements 18 on one side of the inverse-opening slider 1. This protrusion 10 is capable of coming into contact with a front end of the lower plate 28. Further, the box pin 3 has an expanded portion 9, which is provided on an outer side face thereof on the side of its front end such that it is expanded outward toward the diamond 22 of the body 21, so that when it is fitted in the inverse-opening slider 1, it comes into contact with the insert pin 4 inserted in the guide groove 23 for guiding the fastener elements 18 on the other side of the inverse-opening slider 1. Consequently, proceeding direction of the insert pin 4 is changed so as to avoid a collision of the insert pin 4 onto the diamond 22 of the inverse-opening slider 1.

An inner side face, that is, an edge portion on the side of the fastener tape 17 of the box pin 3 is molded in a shape matching an inner side face of a flange 26 of the inverse-opening slider 1, so that the box pin 3 can be held in a stable condition within the inverse-opening slider 1. Further, a slope 6 for raising the locking pawl 25 of the slider 5 is provided obliquely at a proximal end portion, that is, on the surface of a side adjoining the fastener element 18 of the box pin 3, so that the slider 5 is held such that the locking pawl 25 rides over the surface of the box pin 3. Further, a tongue-like small piece 12 is protruded on an outer side face at the proximal end of the box pin 3 so as to fit into a recess 11 provided in an outer side face near the proximal end of the insert pin 4. Consequently, the insert pin 4 and the box pin 3 are held in a condition that they do not deviate from each other in the direction of front and rear surfaces of the fastener chain 15.

As shown in FIG. 1, the insert pin 4 of the releasable bottom end stop is molded in the form of a square bar on a side edge of the reinforcement tape 20 welded on an end of the fastener tape 17. The insert pin 4 is formed thinner than the box pin 3 so that it is easy to be inserted. Further, a slope 6 is provided in the surface of the insert pin 4 on an inner side of the insert pin 4, that is, the side of the fastener tape 17, such that it is inclined from a front end up to around the center of the insert pin 4 toward the proximal end thereof. Consequently, the locking pawl 25 of the inverse-opening slider 1 is raised gradually, so that the locking pawl 25 rides on the surface of the insert pin 4 without any resistance. Further, a small concave portion 7 is formed nearer the proximal end than the slope 6, so that automatic locking pawl 25 of the inverse-opening slider 1 fits in the portion and is held. An inclined chamfered portion 8 is formed around an inlet of the concave portion 7, so that when pulling out the insert pin 4 from the inverse-opening slider 1, the locking pawl 25 can escape from the concave portion 7 easily. The recess 11, into which the small piece 12 of the box pin 3 can fit, is formed on an outer side face of the proximal end of the insert pin 4 so as to hold the insert pin 4 and the box pin 3 from deviating from each other in the direction of the front and rear surfaces of the fastener tape 17.

Figure 5:
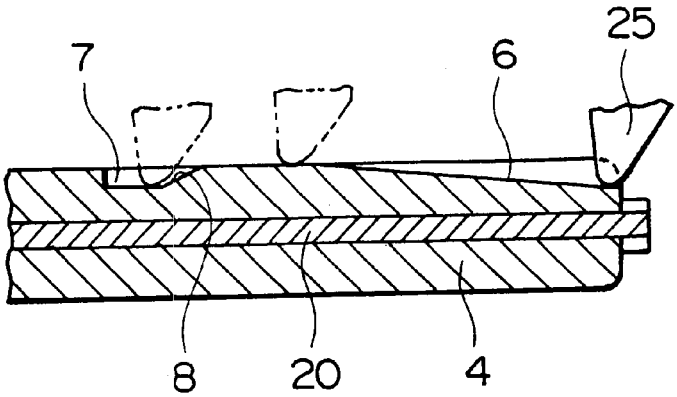
FIG. 5 is a longitudinal sectional view of a major portion of the insert pin in the releasable bottom end stop of FIG. 1.

According to use condition of the releasable bottom end stop, the inverse-opening slider 1 is arranged by fitting into the fastener stringer 16 provided with the box pin 3 as shown in FIG. 2 and then, with this condition, another slider 5 is inserted so as to be brought into contact with the inverse-opening slider 1. With conditions shown in FIGS. 3, 4, 5, the fastener stringer 16 having the insert pin 4 is inserted into the guide groove 23 of the slider 5 and then, inserted into the inverse-opening slider 1. After both the fastener stringers 16 are arranged by pulling, the slider 5 is pulled up so as to close the fastener chain 15.

When opening the fastener chain 15 in inverse-opening condition, the inverse-opening slider 1, which is closed now, is pulled upward in the opening direction of the fastener chain 15, so that the fastener chain 15 is opened to separate the right and left fastener stringers 16.

Figure 7:
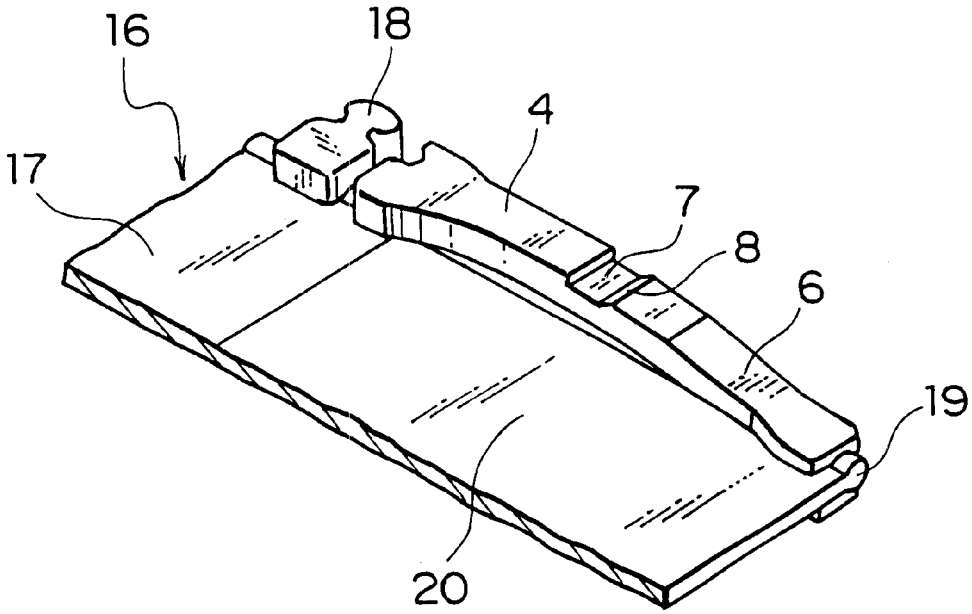
FIG. 7 is a perspective view showing a modification of the insert pin.

According to a modification of the insert pin 4 shown in FIG. 7, the slope 6 formed at the surface of the insert pin 4 for raising the locking pawl 25 of the inverse-opening slider 1 and the concave portion 7 for fitting the locking pawl 25 therein are formed in the entire width of the insert pin 4, so that they are adaptable for the locking pawl 25 with any shape of the automatic stop mechanism, thereby ensuring smooth inserting and fitting operation of the insert pin 4.

Figure 8:
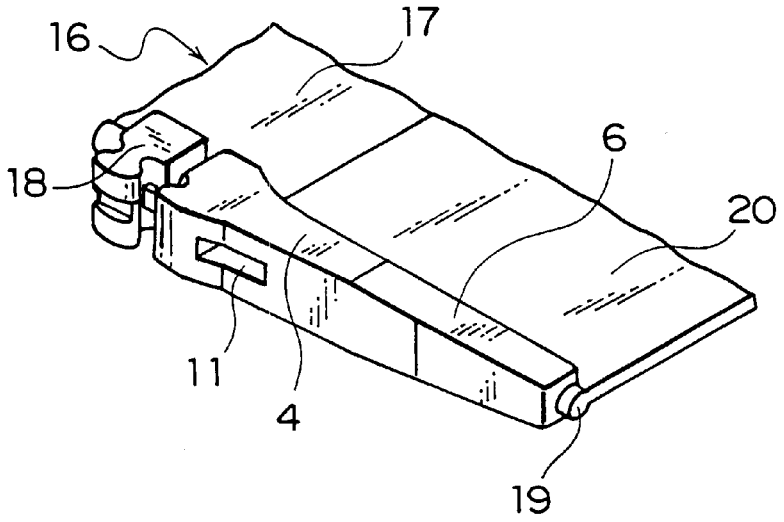
FIG. 8 is a perspective view showing a further modification of the insert pin.

According to another modification of the insert pin 4 shown in FIG. 8, the slope 6 for raising the automatic locking pawl 25 of the automatic stop mechanism is also formed on a rear surface of the insert pin 4, so that the insert pin 4 can be inserted into the inverse-opening slider 1 from any direction of right and left. This kind of the insert pin 4 is formed to be adapted for reversible clothes such as a jumper. Meanwhile, the concave portion 7, in which the locking pawl 25 can fit and engage, may be provided at the insert pin 4 freely.

Figure 9:
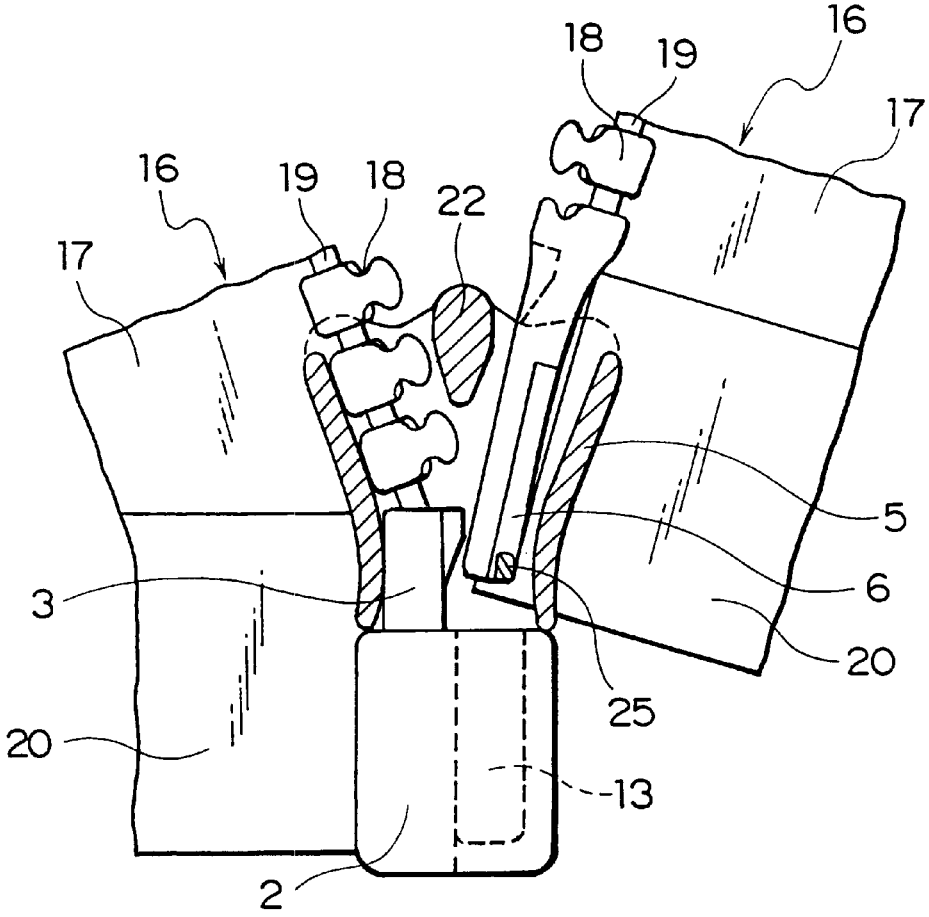
FIG. 9 is a partially sectional view showing an initial phase of an insertion of the insert pin in an ordinary type releasable bottom end stop.
Figure 10:
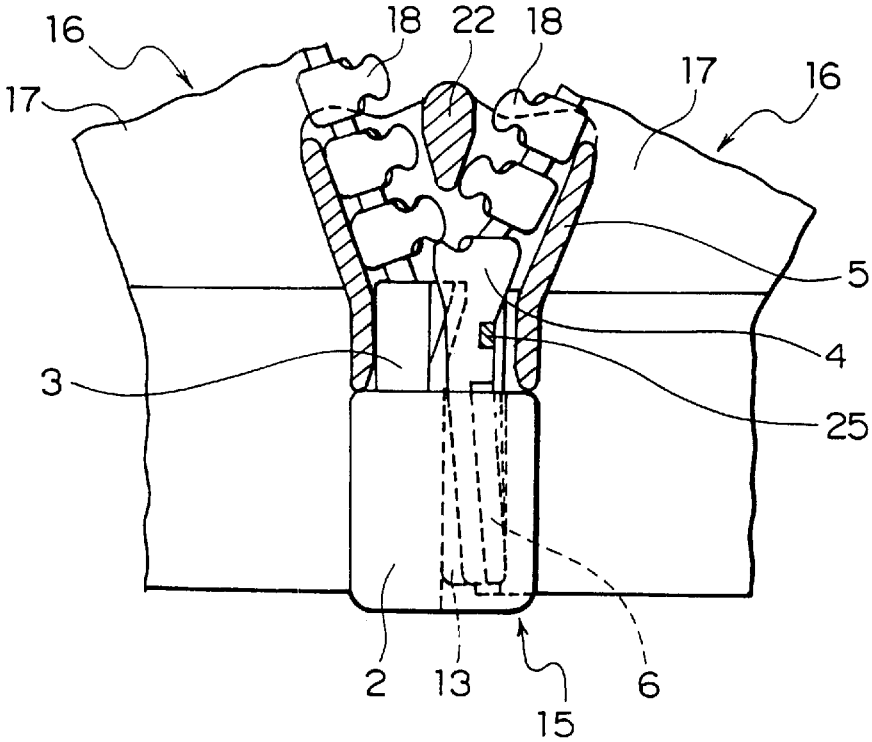
FIG. 10 is a partially sectional view showing a state in which the insert pin of the releasable bottom end stop of FIG. 9 is inserted completely.
Figure 11:
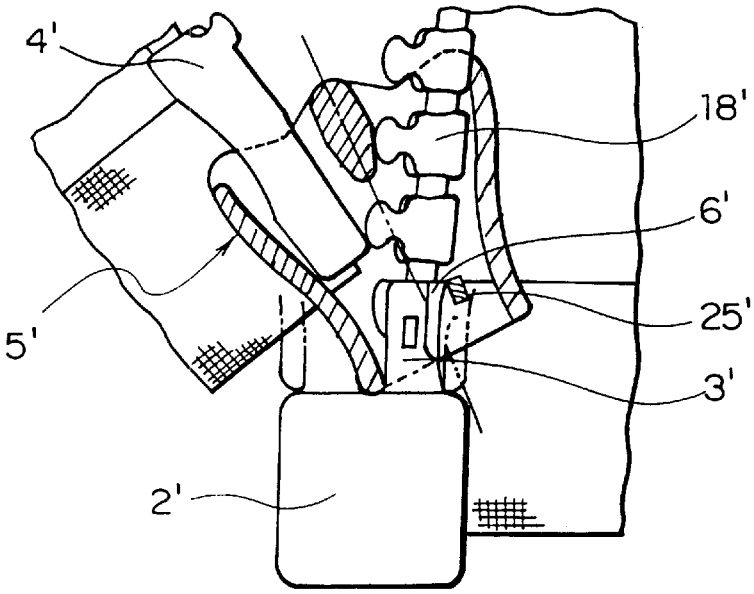
FIG. 11 PRIOR ART
FIG. 11 is a partially sectional view showing an initial phase of the insert pin in a well-known releasable bottom end stop.
Figure 12:
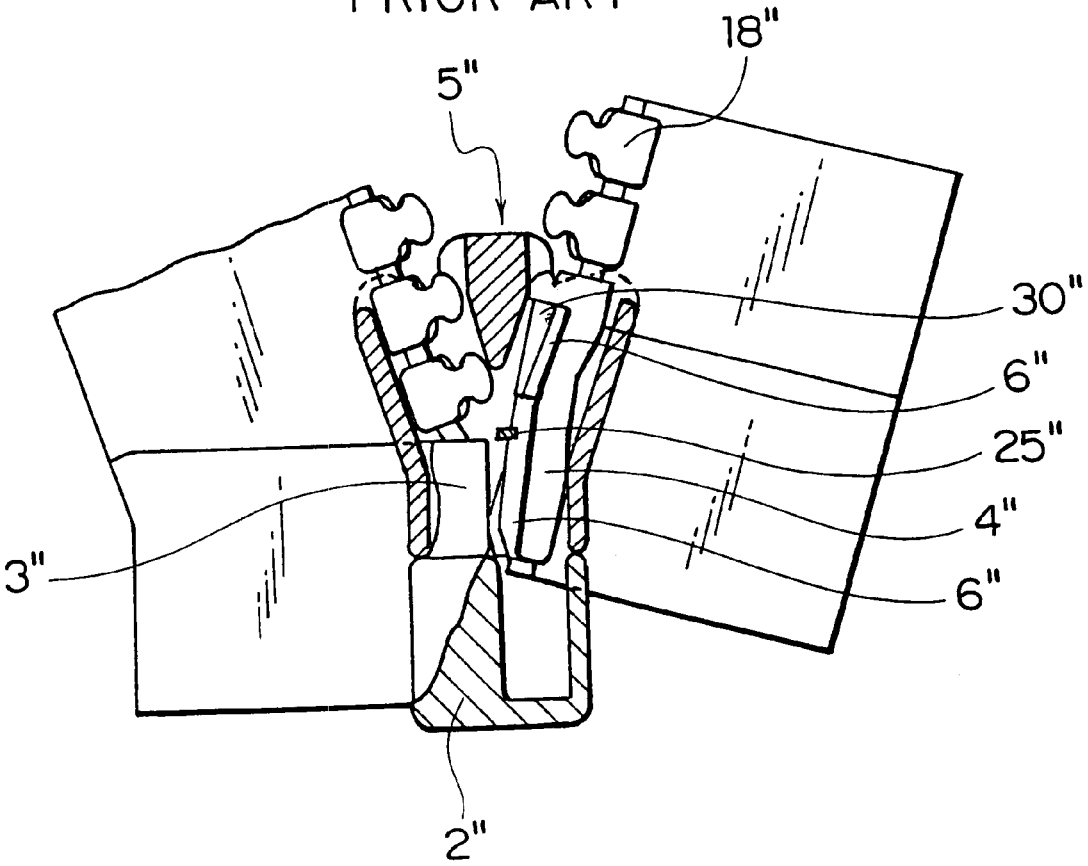
FIG. 12 PRIOR ART
FIG. 12 is a partially sectional view showing an initial phase of the insert pin in other well-known releasable bottom end stop.

A releasable bottom end stop of a second embodiment of the invention shown in FIGS. 9 and 10 is an ordinary type releasable bottom end stop comprised of three members including the body 2, the box pin 3 and the insert pin 4. The box 2 is formed on an edge of the reinforcement tape 20, which wraps the core portion 19 provided on an edge of one fastener stringer 16, by injection molding with thermoplastic resin, such that the box 2 and the box pin 3 are fixed temporarily. Then, an insertion hole 13, in which the insert pin 4 can be inserted, is provided adjacently to the box pin 2 fixed to the box 2.

The insert pin 4 is formed in the form of a square bar on a side edge of the reinforcement tape 20, which wraps the core portion 19 provided on a side edge of the other fastener stringer 16 by injection molding with thermoplastic resin. The insert pin 4 has the slope 6, which is formed on a inner side surface of the insert pin 4, that is, the side of the fastener tape 17 such that it is inclined from a front end to near the center thereof toward the proximal end of the insert pin. Consequently, the locking pawl 25 of the automatic stop mechanism of the slider 5 is raised gradually, so that the locking pawl 25 rides on the surface of the insert pin 4 without any resistance.

As for use condition of the ordinary type releasable bottom end stop described above, as shown in FIG. 9, the slider 5 is inserted through the fastener stringers 16 having the box 2 and the box pin 3 and then, the insert pin 4 is inserted into the other guide groove 23 of this slider 5 and pushed in while making the locking pawl 25 into contact with the slope 6 and gradually raising the locking pawl 25. If the insert pin 4 is inserted into an insert pin insertion hole 13 of the box 2, the insertion operation of the insert pin 4 is terminated. Then, by pulling up the slider 5, the fastener chain 15 is closed. To separate the closed fastener chain 15, the slider 5 disposed in the closed fastener chain 15 is pulled down so as to make contact with the box 2 and after that, the fastener stringer 16 having the insert pin 4 is pulled out of the box 2. Consequently, the fastener chain 15 can be separated.

Meanwhile, in the ordinary releasable bottom end stop also, it is permissible to form the slope 6 in the entire width of the insert pin 4 or on both surfaces thereof and provide the concave portion 7 continuous from the slope 6 if desired. The above-mentioned slider may be a slider with a semiautomatic stop mechanism, in which the locking pawl has the function of a spring and a rotary shaft of a pull is provided with a cam so that by turning the pull, the locking pawl can be introduced into the guide groove.

What is claimed is:

1. A releasable bottom end stop for slide fastener, wherein an insert pin thereof has a slope for raising a locking pawl of a slider, the slope being provided to extend upward from a front end of a surface of the insert pin to a proximal end thereof.

2. A releasable bottom end stop for slide fastener according to claim 1, wherein the insert pin of the releasable bottom end stop comprised of a box, a box pin and an insert pin has the slope for raising the locking pawl.

3. A releasable bottom end stop for slide fastener according to claim 1, wherein the insert pin of the releasable bottom end stop comprised of an inverse-opening slider, a box pin and an insert pin has the slope for raising the locking pawl.

4. A releasable bottom end stop for slide fastener according to claim 1, wherein the slope for raising the locking pawl is provided obliquely in the entire width of the surface of the insert pin.

5. A releasable bottom end stop for slide fastener according to claim 1, wherein the slope for raising the locking pawl is provided obliquely on an inner side of the surface of the insert pin.

6. A releasable bottom end stop for slide fastener according to claim 1, wherein the slope for raising the locking pawl is provided obliquely on both front and rear surfaces of the insert pin.

7. A releasable bottom end stop for slide fastener according to claim 1, wherein a concave portion for fitting the locking pawl therein is provided nearer the proximal end of the insert pin than the slope provided thereon.

8. A releasable bottom end stop for slide fastener according to claim 7, wherein the concave portion for fitting the locking pawl therein provided in the insert pin has a chamfered portion formed obliquely on an inlet portion thereof.

9. A releasable bottom end stop for slide fastener according to claim 3, wherein a protrusion for preventing the inverse-opening slider from escaping is provided at a front end of the box pin.

10. A releasable bottom end stop for slide fastener according to claim 3, wherein an expanded portion for saving of the insert pin is provided on an outer side face on the side of a front end of the box pin.

11. A releasable bottom end stop for slide fastener, wherein a slope for raising a locking pawl is provided obliquely on an end portion of a side of a fastener element of a box pin, the slope being provided to extend upward from a front end of a surface of the box pin to a proximal end thereof.

* * * * *